US008147297B2

(12) United States Patent
Hamm et al.

(10) Patent No.: US 8,147,297 B2
(45) Date of Patent: Apr. 3, 2012

(54) SURFACE GRINDING MACHINE AND GRINDING HEAD THEREFOR

(75) Inventors: Derrick L. Hamm, Sparta, NC (US); John E. Smith, Independence, VA (US); Willis D. Ward, Independence, VA (US)

(73) Assignee: Amano Pioneer Eclipse Corporation, Sparta, NC (US)

( * ) Notice: Subject to any disclaimer, the term of this patent is extended or adjusted under 35 U.S.C. 154(b) by 569 days.

(21) Appl. No.: 12/359,378

(22) Filed: Jan. 26, 2009

(65) Prior Publication Data

US 2010/0190421 A1 Jul. 29, 2010

(51) Int. Cl.
*B24B 23/00* (2006.01)

(52) U.S. Cl. ..... 451/353; 451/350; 451/270; 451/360; 451/359

(58) Field of Classification Search ..... 451/350, 451/353, 270–271, 361–360, 362–363, 359; 125/2, 3, 4, 9; 277/394, 402, 549; 15/49.1, 15/98, 180, 87
See application file for complete search history.

(56) References Cited

U.S. PATENT DOCUMENTS

| | | | | | |
|---|---|---|---|---|---|
| 878,269 | A | * | 2/1908 | Beck | 451/353 |
| 982,408 | A | * | 1/1911 | Alloway | 451/352 |
| 1,000,696 | A | * | 8/1911 | Schlueter | 451/353 |
| 1,377,537 | A | * | 5/1921 | Wimmer | 29/81.05 |
| 2,213,432 | A | * | 9/1940 | McCartney | 384/202 |
| 2,235,446 | A | * | 3/1941 | Birger et al. | 451/67 |
| 2,290,215 | A | * | 7/1942 | Stenberg | 403/328 |
| 2,316,886 | A | * | 4/1943 | Pascucci | 451/353 |
| 2,851,291 | A | * | 9/1958 | Payne | 277/394 |
| 2,960,705 | A | * | 11/1960 | Nilsson et al. | 15/4 |
| 2,987,741 | A | * | 6/1961 | Feldman et al. | 15/4 |
| 3,061,320 | A | * | 10/1962 | Haensch | 277/384 |
| 3,301,568 | A | * | 1/1967 | Perry | 277/379 |
| 3,464,166 | A | * | 9/1969 | Bouvier | 451/548 |
| 3,517,466 | A | * | 6/1970 | Bouvier | 451/490 |
| 3,552,070 | A | * | 1/1971 | Reiss | 451/353 |
| 3,673,744 | A | * | 7/1972 | Oimoen | 451/353 |
| 3,946,692 | A | * | 3/1976 | Sierra et al. | 114/222 |
| 4,219,898 | A | * | 9/1980 | Presby | 15/49.1 |
| 4,237,571 | A | * | 12/1980 | Nelson | 15/49.1 |
| 4,328,645 | A | * | 5/1982 | Sauer | 451/359 |
| 4,848,960 | A | * | 7/1989 | Kajioka et al. | 404/112 |
| 5,070,656 | A | * | 12/1991 | Brogden | 451/353 |
| 5,081,734 | A | * | 1/1992 | Sandford et al. | 15/93.1 |
| 5,492,337 | A | * | 2/1996 | Lederman | 277/307 |
| 5,758,880 | A | * | 6/1998 | Ice et al. | 277/375 |
| 5,882,086 | A | * | 3/1999 | Bremner et al. | 299/41.1 |

(Continued)

FOREIGN PATENT DOCUMENTS

EP 0974424 A1 1/2000

(Continued)

*Primary Examiner* — George Nguyen
(74) *Attorney, Agent, or Firm* — Novak Druce + Quigg LLP

(57) ABSTRACT

A surface grinding machine generally consisting of a drive means provided with an output shaft; a planetary disk mounted on the shaft; and at least two grinding head units mounted on the planetary disk, each including a housing mounted on the planetary disk, a shaft having a flange portion, journaled in the unit housing, resilient means interposed between the housing and the flange portion of the unit shaft and a disk provided with a grit surface disposed on an outer side of the flange portion of the unit shaft.

20 Claims, 4 Drawing Sheets

U.S. PATENT DOCUMENTS

| | | | | |
|---|---|---|---|---|
| 5,979,000 | A * | 11/1999 | Gansow | 15/49.1 |
| 6,173,963 | B1 * | 1/2001 | Ho et al. | 277/361 |
| 6,425,169 | B1 * | 7/2002 | Briscoe | 29/90.01 |
| 6,887,133 | B1 * | 5/2005 | Halley | 451/41 |
| 7,297,188 | B2 * | 11/2007 | Nielsen et al. | 96/279 |
| 2006/0025059 | A1 | 2/2006 | Gueorguiev | |
| 2010/0190421 | A1 | 7/2010 | Hamm | |
| 2010/0203813 | A1 * | 8/2010 | Ward et al. | 451/353 |

FOREIGN PATENT DOCUMENTS

| | | | |
|---|---|---|---|
| EP | 1985876 | A1 | 10/2008 |
| EP | 2036668 | A1 | 3/2009 |

* cited by examiner

SURFACE GRINDING MACHINE AND GRINDING HEAD THEREFOR

FIELD OF THE INVENTION

This invention relates to a machine for grinding surfaces such as concrete floors and the like, and more particularly to such a machine which is more effective in grinding rough surfaces into smooth surfaces.

BACKGROUND OF THE INVENTION

In the finishing of concrete and stone floors, it customarily is the practice to grind and polish the surfaces of such floors to provide consistently smooth finishes. Such finishing typically is performed by machines consisting of a motor, a planetary disk mounted on an output shaft of the motor and a disk provided with a grit surface mounted on the planetary disk. In the use of such machines, however, because of the uneven surfaces of floors and the planar surfaces of grinding disks, it has been found that low spots of floor surfaces are not effectively ground and polished unless an excessive amount of concrete or stone is removed to make the floor even and planar. Such condition results in not only the removal excess material but the excessive use of grinding disks, energy and manpower.

In the prior art, there has been developed a type of machine intended to address the shortcoming of prior machines as described which utilizes a carrier disk mounted on the output shaft of the motor, a planetary disk provided with a plurality of grinding heads mounted thereon and a compression spring interposed between the carrier and planetary disks. Such machine, however, also has been found to be ineffective in achieving planar surfaces of uneven concrete or stone floors without excessive grinding and the use of excessive grinding disks, energy and manpower. Accordingly, it is the principal object of the present invention to provide a machine of the type described which is operable and effective in grinding and polishing an uneven concrete or stone surface to a consistently smooth floor without the excessive removal of material and the use of excessive amounts grinding disks, energy and manpower.

SUMMARY OF THE INVENTION

The principal object of the present invention is achieved by providing a surface grinding machine generally consisting of a motor provided with an output shaft; a planetary disk mounted on such shaft; and a number of circumferencially spaced grinding head units mounted on such planetary disk, each including a housing mounted on the planetary disk, a shaft having a flanged portion journaled in such unit housing, resilient means disposed between the housing and such flanged portion of the unit shaft and a disk provided with an abrading surface disposed on an outer side of the flange portion of the unit shaft. In such an arrangement, the grinding disk of each of such units is functional to displace relative to the planetary disk on which it is mounted, independently of the grinding disks of the other grinding heads.

DETAILED DESCRIPTION OF THE PREFERRED EMBODIMENT OF THE INVENTION

Figure 1:
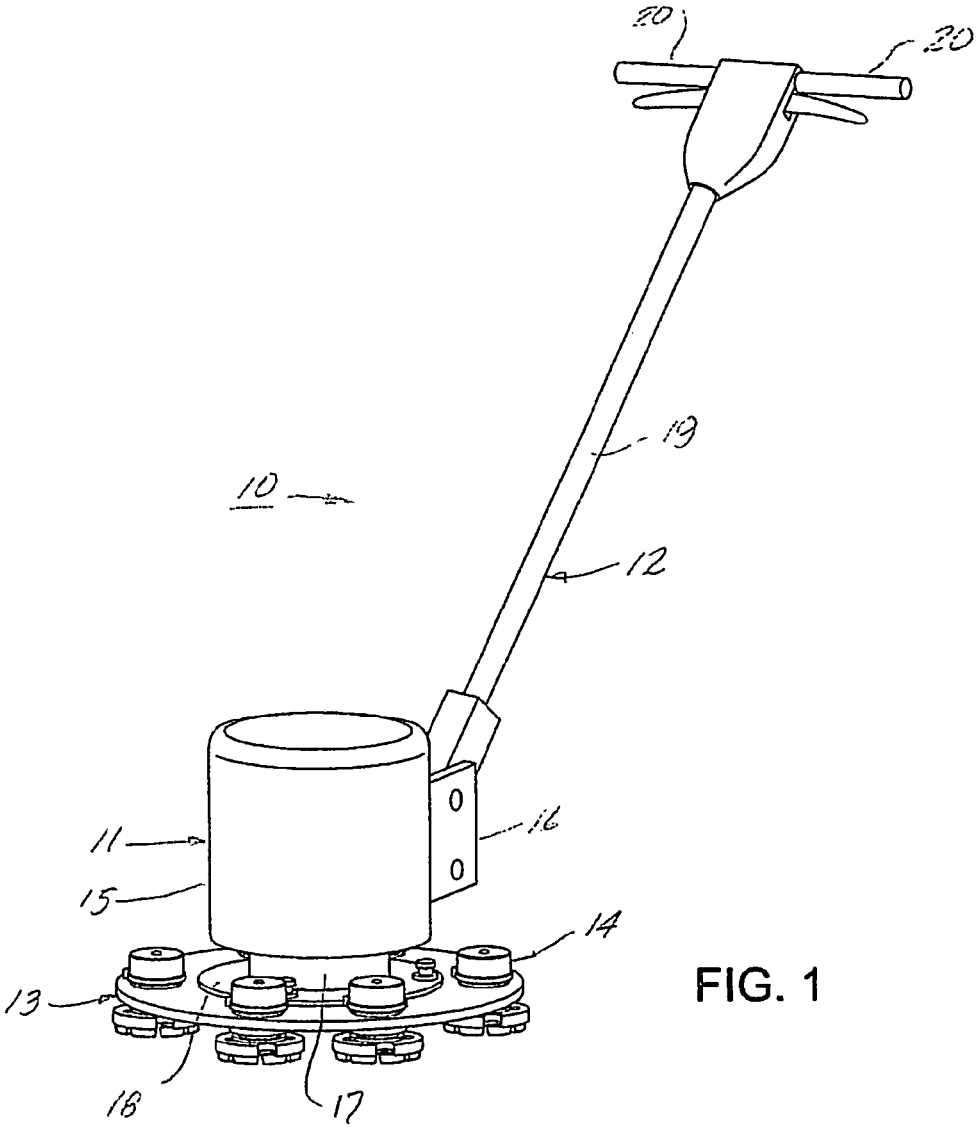
FIG. 1 is a perspective view of a floor grinding machine embodying the present invention.
Figure 2:
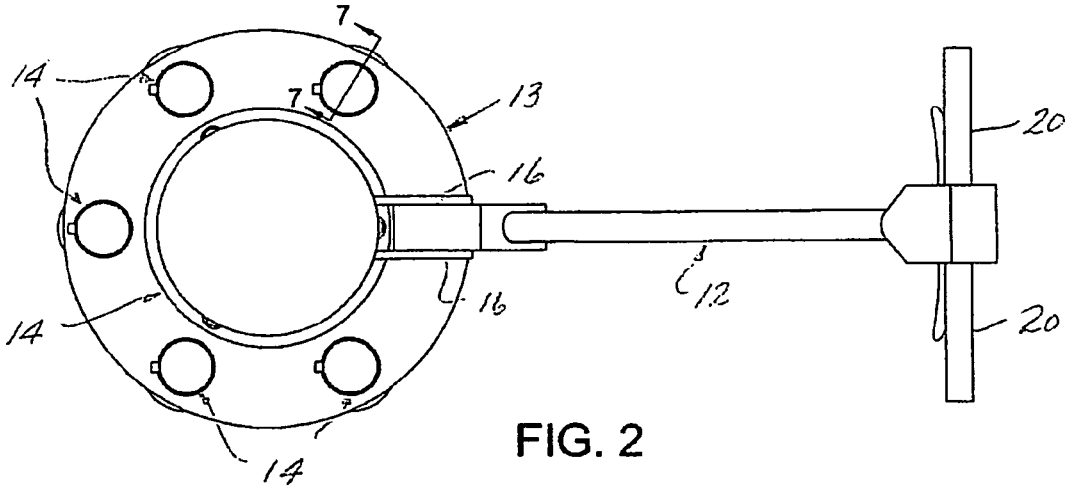
FIG. 2 is a top plan view of the machine shown in FIG. 1.

Referring to FIGS. 1 and 2 of the drawings, there is illustrated a floor grinding machine 10 embodying the present invention which generally includes a motor assembly 11, a handle assembly 12, a planetary disk 13 and a plurality of grinding head units 14. Motor assembly 11 includes a motor mounted within a housing 15 provided with a set of brackets 16, 16, having a depending output shaft. Mounted on the end of the output shaft is a carrier member 17 provided with an annular flange 18. Handle assembly 12 includes an elongated member 19 having a lower end received within and pivotally connected to brackets 16, 16, and a pair of handles 20, 20 disposed at an upper, free end thereof which may be gripped by an operator to guide the machine over a floor surface to be worked. The motor of the machine may be either an internal combustion engine or an electric motor and may be operated in the conventional manner with controls mounted on the handle assembly adjacent handles 20, 20.

Figure 3:
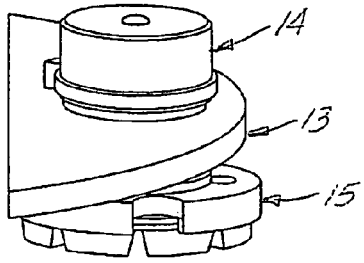
FIG. 3 is an enlarged, partial view of the planetary disk of the machine shown in FIGS. 1 and 2.

Planetary disk 13 is detachably mounted on the underside of flange portion 18 of carrier member 17 for rotational movement therewith as the motor is operated. As best seen in FIGS. 2 and 3, the planetary disk is provided with a plurality of circumferencially spaced circular openings 21, in which there is a mounted a set of grinding head units 14.

Figure 4:
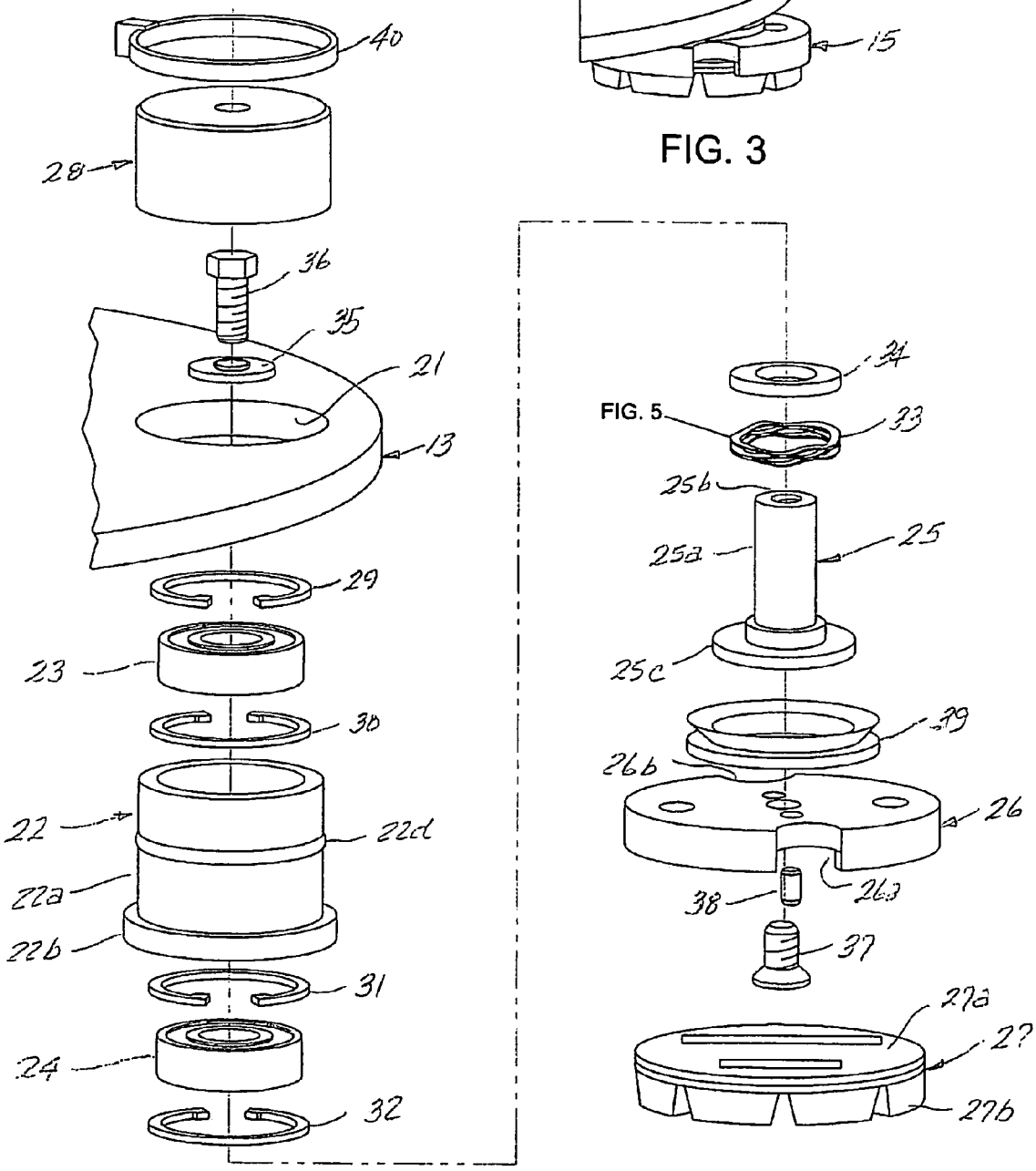
FIG. 4 is an enlarged, exploded view of the grinding head unit shown mounted on the planetary disk in FIG. 3.
Figure 8:
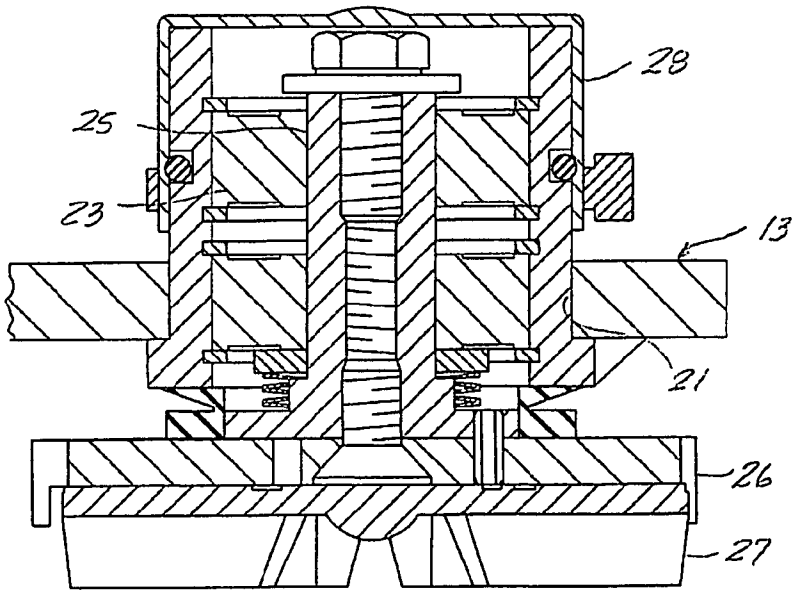
FIG. 8 is a view similar to the view shown in FIG. 7, illustrating the grinding disk disposed in a compressed position.
Figure 7:
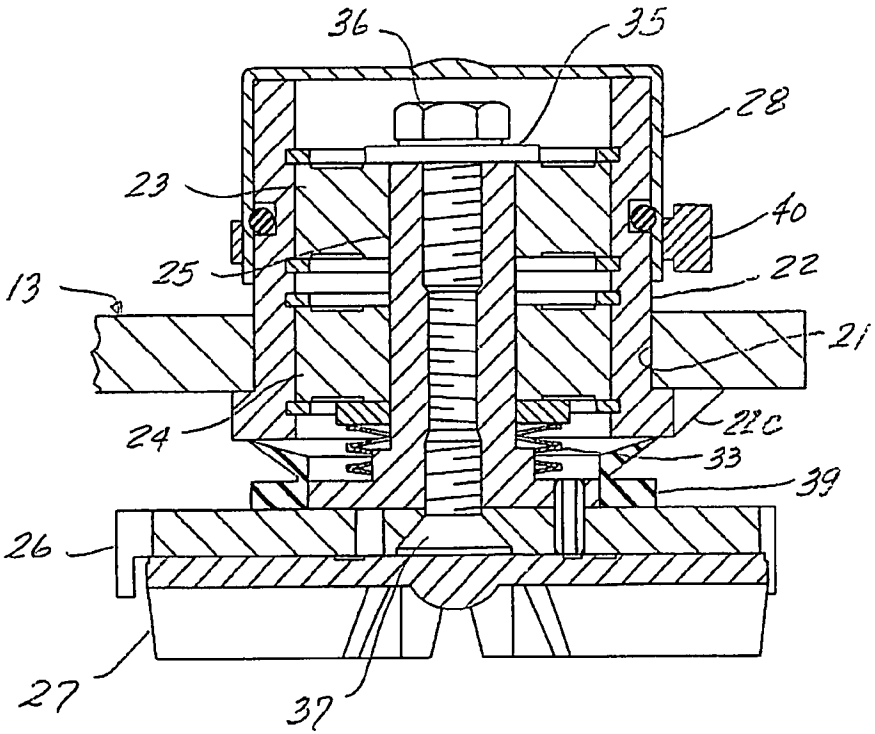
FIG. 7 is an enlarged cross-sectional view taken along line 7-7 in FIG. 2, illustrating the grinding disk thereof disposed in an extended position.

As best seen in FIGS. 4, 7 and 8, each grinding head unit 14 includes a housing 22, a set of bearings 23 and 24, a shaft 25, a disk holder 26, a grinding disk 27 and a cap 28. Housing 22 includes an annular portion 22*a* adapted to be received through the lower end of an opening of 21 in planetary disk 13, and a lower flange portion 22*b* which is adapted to engage a lower surface of planetary disk 13 when inner portion 22*a* is received in an opening 21. The housing is retained in an opening 21 as shown in FIGS. 7 and 8 by welding as at 22*c* or any other suitable means for firmly securing the housing of the unit to the planetary disk. The outer surface of cylindrical portion 22*a* further is provided, with an annular grove for receiving and an o-ring 22*d*. Bearings 23 and 24 are mounted in housing 22 in spaced relation as shown in FIGS. 7 and 8, and are retained therein by a set of split retainer rings 29 through 32 received in spaced annular recesses formed in an inner wall surface of the housing, as shown in FIGS. 7 and 8.

Figure 5:
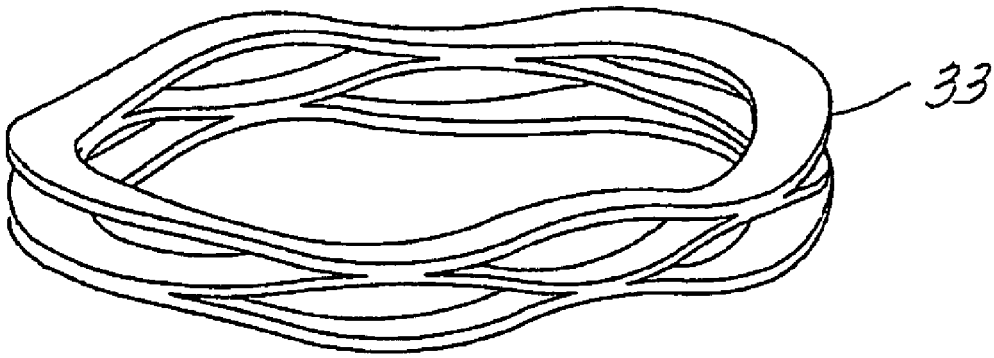
FIG. 5 is an enlarged, perspective view of an annular wave spring provided in the grinding head unit shown in FIGS. 3 and 4.
Figure 6:
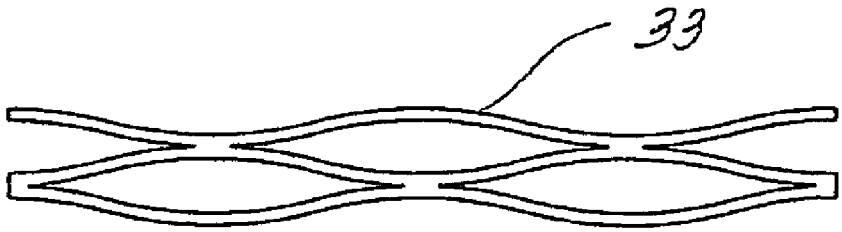
FIG. 6 is a side elevational view of the spring shown in FIG. 5.

Shaft 25 includes an upper, cylindrical portion 25*a* provided with an axially disposed threaded opening 25*b*, and a lower annular flange portion 25*c*. An annular wave spring 33, as best seen in FIGS. 5 and 6, is seated on annular flange portion 25*c* of the shaft, and an annular spacer 34 rests on spring 33. Cylindrical portion 25*a* of the shaft is received within and journaled in bearings 23 and 24 mounted in housing 22, and is retained therein by means of a washer 35 mounted on the upper end of cylindrical shaft portion 25*a* and a bolt 36 extending through washer 35 and threaded into opening 25*b* of the shaft. As best illustrated in FIGS. 7 and 8, the length of shaft portion 25*a* is slightly greater than the spacing between an upper surface of bearing 23 and a lower surface of spacer 34 when the head unit is assembled as shown in FIGS. 7 and 8, to permit limited axial displacement of the shaft relative to bearings 23 and 24.

Holder disk 26 is circular in configuration with a pair of diametrically opposed notches 26*a* and 26*b*. It is mounted on the underside of shaft annular flange portion 25*c* and is firmly secured thereto by means of a screw 37. Grinding disk 27 is consumable and therefore is detachably mounted on the underside of disk holder 26. Disk 27 can be detachably mounted on the underside of disk holder 26 by any suitable means although the use of materials providing interconnecting hook and loop surfaces has been found to be suitable in detachably connecting the disk to the disk holder.

The upper end of housing 22 is closed by cup-shaped cap 28 which is mounted on the upper end thereof. An annular elastomer fastener 40 is provided to engage the sides of the cap number and hold it firmly on the upper end of housing 22. O-ring 22*d* disposed in the annular grove of housing 22 is engaged by the side wall of the cap to form a seal and thus preclude the entry of foreign matter into the interior of housing 22.

Each grinding head unit as described may be mounted and assembled in an opening 21 of planetary disk 13 by first inserting a housing 22 in an opening 21 of planetary disk 13, and securing such housing therein by welding or any other suitable means. Retainer rings 29 through 32 and bearings 23 and 24 are then inserted in the mounted housing so that the bearings are axially aligned and spaced within the housing. Annular spring 33 and spacer 34 are then positioned on shaft 25, resting on lower flange portion 25*c*, and the upper end of the shaft is inserted into the bearings within the housing. The shaft is secured within the bearings by placing washer 35 on the upper end the inserted shaft which is engagable with an outer side of bearing 23, and inserting a bolt 36 through the washer and threading it into opening 25*b*. With the shaft thus mounted in housing 22, seal 39 is fitted about the side edge of shaft annular portion 25*c*, engaging the lower end of housing 22. Disk holder 26 is then positioned on the lower surface of shaft annular portion 25*c* and secured thereto with a screw 37. In doing so, the openings in disk holder 26 and shaft flange portion 25*c* are aligned and pins 38 are inserted in such aligned openings to preclude the rotational displacement of the holder disk relative to shaft 25. The upper end of the unit is then closed by fitting an o-ring on housing 22, fitting cap number 28 on the upper end of the housing, and securing the cap member thereon by means of fastener 40 fitted about the side wall of the cap member.

With each of the grinding head units thus mounted on the planetary disk in the manner as described, the planetary disk may then be secured to the underside of flange portion 18 of carrier member 17 so that the planetary disk with the grinding head units mounted thereon will rotate when the motor of the machine is operated, in the conventional manner.

When the machine is to be used to finish a concrete or stone surface, grinding disks 27 are mounted on the units simply by positioning them against the undersides of disk holders 26 and applying pressure to cause such disks to detachably mount on the disk holders. With the machine thus assembled and the grinding disks mounted, the machine may be operated in the conventional manner by guiding the planetary disk with the mounted grinding disks over the concrete or stone surface of a floor to permit the grinding heads to engage and grind the floor surface. By providing for the vertical flexing of the grinding disk of each grinding head unit, independent of the other units, the machine will function to grind both high and low spots of the floor thus providing a consistently smooth floor surface while minimizing the amount of material being removed from the floor. The resilient mounting of each of the grinding disks permits such disk to flex axially and thus adapt to the contour of the floor. As the planetary disk of the machine is guided over the floor surface being ground by the operator, each of the grinding disks will not only be free to flex axially but to rotate about the axis of the bearings in which the support shaft is journaled.

Once the grit portion of a grinding disk is worn and requires replacement, such replacement can be performed simply by tipping the machine to provide access to the underside of the planetary disk, gripping the worn disk and detaching it from its holder, and mounting a new disk. To facilitate such removal, such disk may be more easily gripped by inserting fingers of the gripping hand through notches 26*a* and 26*b* to more firmly grasp the grinding disk and apply a force to remove it from its holder disk.

Any form of grinding disk may be used with the invention as described, and any means for detachably securing such disk to its disk holder also can be used. However, a grinding disk provided with a diamond grit and a hook and loop securing means has been found to be most satisfactory in use.

The machine as described can be used to grind any hard surface floor including floors formed of concrete, stone, marble, terrazzo, granite and similar materials. It may be driven by an internal combustion engine, an electric motor or a battery driven motor. Furthermore, any suitable device providing flexing of each grinding head relative to its planetary disk may be used, which may be formed of any suitable material including metals and plastics.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. A surface grinding machine, comprising;

a drive means provided with an output shaft;

a planetary disk mounted on said shaft; and at least two grinding head units each including a housing mounted on said planetary disk, a unit shaft having a flange portion, journaled in said unit housing, resilient means interposed between said unit housing and said flange portion of said unit shaft and a disk provided with a grit surface disposed in an outer side of the flange portion of said unit shaft.

2. A machine according to claim 1 wherein said drive means is disposed in a housing, and including a handle mounted to said motor housing.

3. A machine according to claim 1 wherein said planetary disk is disposed in a plane perpendicular to the axis of said output shaft, and said units are circumferentially spaced relative to said axis.

4. A machine according to claim 1 wherein said unit housing is rigidly mounted on said carrier disk.

5. A machine according to claim 1 wherein said planetary disk is provided with at least two openings and each of said unit housings is disposed in one of said openings.

6. A machine according to claim 1 including at least one bearing mounted in said unit housing and wherein said unit shaft is journaled in said bearing.

7. A machine according to claim 1 wherein said resilient means comprises a spring.

8. A machine according to claim 7 wherein said spring comprises an annular wave spring.

9. A machine according to claim 1 wherein said unit disk is detachably secured to said unit shaft.

10. A machine according to claim 1 including a seal disposed between said flange portion of said unit shaft and said housing, circumscribing said resilient means.

11. A grinding head unit mountable on a planetary disk of a surface grinding machine comprising:

a housing mountable on said planetary disk;

a shaft having a flange portion journaled in said housing;

resilient means interposed between said housing and said flange portion of said shaft biasingly extending said flange portion; and a disk provided with a grit surface disposed on an outer side of said flange portion of said shaft.

12. A machine according to claim 11 including at least one bearing mounted in said unit housing and wherein said shaft is journaled in said bearing.

13. A machine according to claim 11 wherein said resilient means comprises a spring.

14. A machine according to claim 13 wherein said spring is an annular wave spring.

15. A machine according to claim 11 wherein said disk is detachably secured to said shaft.

16. A machine according to claim 11 including a seal disposed between said flange portion of said unit shaft and said housing, circumscribing said resilient means.

17. A unit according to claim 11 including means for restricting the axial displacement of said shaft relative to said housing.

18. A unit according to claim 17 wherein said restricting means includes an annular member mounted on said shaft, engageable with a member mounted in said housing.

19. A unit according to claim 17 wherein said restricting means includes an annular member supported on said housing, engageable by a segment of said flange portion of said shaft.

20. A unit according to claim 11 wherein said disk includes a base member mountable on said flange portion of said shaft and a detachable member including said grit surface.

* * * * *